US006179185B1

(12) United States Patent
Dancyger

(10) Patent No.: US 6,179,185 B1
(45) Date of Patent: Jan. 30, 2001

(54) SPECIALLY CONFIGURED TOOL CARRIER

(76) Inventor: Michael Dancyger, 811 W. 58th St., Los Angeles, CA (US) 90037

( * ) Notice: Under 35 U.S.C. 154(b), the term of this patent shall be extended for 0 days.

(21) Appl. No.: 09/378,594

(22) Filed: Aug. 20, 1999

(51) Int. Cl.[7] ..... A45C 15/00

(52) U.S. Cl. ..... 224/576; 224/577; 224/674; 224/677; 224/682; 224/904; 206/373; D3/228

(58) Field of Search ..... 224/904, 575, 224/576, 577, 625, 660, 665, 674, 676, 677, 680, 682, 683, 684; D3/228; 206/373

(56) References Cited

U.S. PATENT DOCUMENTS

D. 302,489 * 8/1989 Stone et al. ..... D3/228
D. 316,485 * 4/1991 Seber ..... 224/904 X
D. 334,286 * 3/1993 Keene ..... 224/904 X
1,275,862 * 8/1918 Danz ..... 224/610
4,923,105 * 5/1990 Snyder ..... 224/904 X
5,228,609 * 7/1993 Gregory ..... 224/625 X
5,639,003 * 6/1997 Utzinger, III ..... 224/904 X
5,653,337 * 8/1997 Cirigliano ..... 224/904 X
5,836,497 * 11/1998 Pelish ..... 224/625 X

* cited by examiner

*Primary Examiner*—Gregory M. Vidovich
(74) *Attorney, Agent, or Firm*—Anora M. Vaccaro

(57) ABSTRACT

The present invention relates to tool carriers usually used on work belts, aprons, bucket carriers and the like. The present invention comprises a tool carrier or bag that has at least one handle on the top thereof so that it can be carried from place to place in an upright position, either while it is still on a work belt that is not currently being worn or being carried by itself. In the preferred embodiment, a structurally strong handle is attached to the back of the tool carrier proximate the area in which a belt may be inserted through the tool carrier by heavy duty attachment means. It is preferable to use two tool carriers each having a handle through which the user's hand is inserted in order to provide even weight distribution when the belt is being carried from place to place.

3 Claims, 1 Drawing Sheet

SPECIALLY CONFIGURED TOOL CARRIER

BACKGROUND OF THE INVENTION

1. Field of the Invention

The invention relates to the field of tool holders that are used by carpenters, electricians, plumbers, roofers, gardeners, students and the like who want the ability to carry many different objects at the same time while working in a convenient and easy to use manner. More specifically, this invention relates to a specially configured tool carrier that is capable of carrying various tools.

2. Description of the Prior Art

In the prior art, numerous tool holding apparatuses have been disclosed that may be inserted or worn on a belt, attached to an apron or mounted on a carrier such as a bucket, box or carton. For example, in order to perform various tasks in their given trades, tradespersons such as electricians, carpenters and plumbers use tool carriers such as belts, aprons, pouches, etc. to transport the various tools that they frequently use to each job site.

The prior art tool carriers usually have one or more pockets or pouches into which small tools and other objects are placed to be carried from job to job. For example, tools, such as screwdrivers, smaller wire cutters, chisels and the like normally are stored in one or more of the larger pockets. Small objects such as nuts, bolts, nails and the like usually are placed in the smaller pockets. The holders also may contain hooks and/or loops through which a variety of tools such as hammers may be suspended.

In the prior art, tool carriers are usually made up of one or more pockets that are substantially square or rectangular in shape. The problem with these prior art pouches is that due to the way they are configured, the pockets are unable to safely contain other types of tools and other items that are often used on various jobs. For example, tools such as electric drills, electric screwdrivers and caulking guns usually do not fit easily into a pocket along with other tools and supplies. Further, to the extent that they do fit, due to the weight distribution of the tool or other item, the tool or item has a tendency to fall out of the pocket. Thus, the shape and configuration of the pockets contained within prior art tool carriers limit the types of tools and other items that may be carried therein. Also in the prior art, the tool carriers must either be worn on a belt or carefully carried from place to place in order to prevent the items and tools contained therein from falling out.

Therefore, there has been a long felt need for a tool carrier which can easily be transported from place to place without a substantial risk of the items and tools contained therein from falling out while the user is in transit from location to location.

The present invention overcomes the disadvantages of prior art tool carriers since the carrier of the present invention allows the user more than one means to securely carry the carrier from place to place. Due to the new and novel configuration of at the tool carrier, it can be carried securely in a upright position even when still attached to a tool belt, while it is not being worn by the user.

SUMMARY OF INVENTION

The present invention relates to tool carriers usually used on work belts, aprons, bucket carriers and the like. The tool carrier of the present invention has one or more pockets which are configured to hold a variety of tools and other objects.

The present invention comprises a tool carrier or bag that has at least one handle on the top thereof so that it can be carried from place to place in an upright position, either while it is still on a work belt that is not currently being worn or being carried by itself.

In the preferred embodiment of the tool carrier, the main body thereof is comprised of at least one holding area having a back surface and a front surface which can contain tools and other objects.

In the preferred embodiment, a structurally strong handle is attached to the back of the tool carrier proximate the area in which a belt may be inserted through the tool carrier by heavy duty attachment means.

In the preferred embodiment it is preferable to two tool carriers each having a handle through which the user's hand is inserted in order to provide even weight distribution when the belt is being carried from place to place.

DESCRIPTION OF PREFERRED EMBODIMENTS

Figure 2:
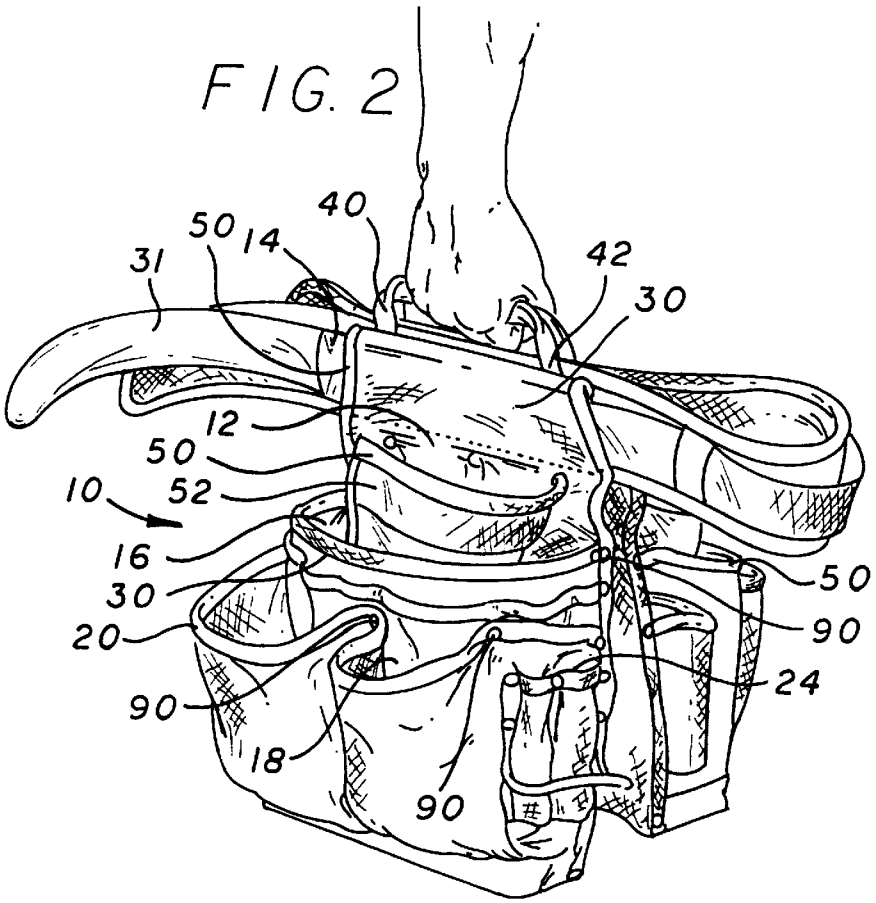
FIG. 2 is a perspective right front view of the tool carrier shown in FIG. 1 as it is being carried by the user.
Figure 1:
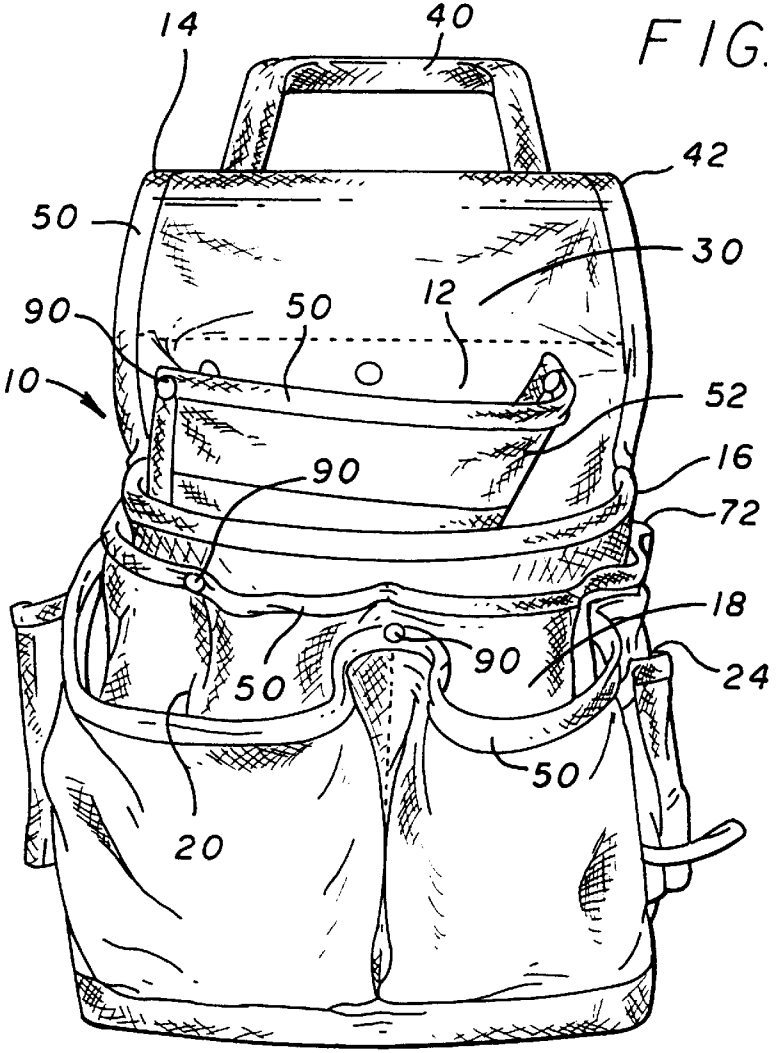
FIG. 1 is a perspective view of the front of the preferred embodiment of the tool carrier of the present invention.

Referring to FIGS. 1–2, the preferred embodiment of the present invention is shown. The tool holder 10 is comprised of a first inner holding area 12, a belt attachment means 14, and a plurality of other pockets and/or holding areas 16, 18, 20, 22 and 24. Belt attachment means 14 is formed by either folding over the top portion of backing 30 and affixing it to the rear of the backing to create an elongated belt loop (not shown) through which belt 31 is threaded.

Handle 40 is attached to the backing 30 proximate the upper end 42 thereof by heavy duty attachment means such as rivets, heavy duty stitching or both. The handle is preferably constructed of a strong heavy duty material so as to be able to carry the weight of the carrier when tools and other objects are contained therein. In the preferred embodiment, the handle is attached to the rear of backing 30.

The backing and handle materials used in the present invention may be comprised of leather, Cordura or any other structurally strong material.

In the preferred embodiment shown in FIG. 2, at least two carriers of the present invention are used so as to provide even weight distribution as the belt containing the tool carriers is carried from place to place.

The pockets may be attached by stitching, riveting or other suitable heavy duty attachment method. In the preferred embodiment, each of the pockets are stitched at their outer edges and bottom and for extra structural support, rivets 90 are also placed proximate each end of the pocket opening and the upper outer edges where the pockets are attached to the sides of backing 30.

It is also contemplated that numerous additional metal bars or other equivalent attachment means may be attached at a corresponding number of additional locations on tool holder 10.

In the preferred embodiment, all of the edges of the tool pouch are reinforced with binding 50 to prevent fraying. Also additional material 52 is attached to the fronts of each pockets to provide additional structural support.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

What is claimed is:

1. An improved tool pouch that may be slidably inserted onto a tool belt so that it can be worn around the waist of a user, the improvement comprising:

a substrate comprised of a top portion, a bottom, a front, a back and a back top, said top portion thereof being folded over and permanently affixed to the back thereof proximate the back top so as to create an elongated belt loop, said elongated belt loop having a first open end and a second open end, such that the tool pouch may be slideably inserted onto said belt by threading the belt through one open end and out the other open end, a plurality of open pockets affixed to the front of said substrate for carrying tools and other items from place to place, and a handle formed of a first end and a second end which are permanently affixed transversely to the back of said elongated belt loop, wherein said first end of said handle is affixed at an area near said first open end of said elongated belt loop and said second end of said handle is affixed at an area near said second open end of said elongated belt loop, said handle extending above said substrate to define a handle opening substantially sized to receive only the hand of a user while said pouch is being worn or carried by a user whereby regardless of whether the tool pouch is placed on or off of the belt, the tool pouch and its contents may be taken from place to place in an upright position by grabbing said handle.

2. The tool pouch of claim 1 wherein said handle is attached to said elongated belt loop so that the ends of said handle lay flat against said belt loop.

3. An improved tool carrier, the improvement comprising;

a work belt having a top and a first front side and an opposite second front side, each side having corresponding means at the ends thereof for closing said belt around the body of the wearer, a first removable pouch for carrying tools and other objects on said first front side spaced apart from said closing means comprising:

a first substrate comprised of a top portion, a bottom, front, back, and back top, said top portion thereof being folded over and permanently affixed to the back thereof proximate the back top so as to create an elongated belt loop, said elongated belt loop having a first open end and a second open end through which said work belt is slidably inserted, a plurality of pockets affixed to the front of said first substrate for carrying tools and other items from place to place, and a first handle formed of a first end and a second end which are permanently affixed transversely to the back of said elongated belt loop in a plane parallel to said front of said first substrate, said handle being capable of extending above said elongated loop, wherein said first end of said handle is affixed at an area near said first open end of said elongated belt loop on said first substrate, and said second end of said handle is affixed at an area near said second open end of said elongated belt loop, said first handle defining a first handle opening extending above the top of said belt loop substantially sized to receive only the hand of a user while said first pouch is being worn on said work belt or otherwise carried by a user, a second removable tool pouch for carrying tools and other objects on the opposite second front side of said belt spaced apart from said closure means comprising:

a second substrate comprised of a top portion, a bottom, front, back and back top, said top portion thereof being folded over and permanently affixed to the back thereof proximate the top so as to create an elongated belt loop, said elongated belt loop having a first open end and a second open end through which said work belt is slidably inserted, a plurality of pockets affixed to the front of said second substrate for carrying tools and other items from place to place, and a second handle formed of a first end and a second end which are permanently affixed transversely to the back of said second elongated belt loop in a plane parallel to said front of said second substrate, wherein said first end of said second handle is affixed at an area near said first open end of said elongated belt loop on said second substrate, and said second end of said second handle is affixed at an area near said second open end of said elongated belt loop, said second handle defining a second handle opening extending above the top of said belt loop substantially sized to receive only the hand of a user while said second pouch is being worn on said work belt or otherwise carried by a user, whereby when said tool carrier is not being worn by the user, it may be taken from place to place in an upright position by grabbing said first and second handles together so as to distribute the weight of said first and second pouches.

* * * * *